US011339557B2

(12) United States Patent
Bilardello

(10) Patent No.: US 11,339,557 B2
(45) Date of Patent: May 24, 2022

(54) PRESSURE ASSISTED PLUNGER DEVICE WITH SWITCHING BELLOWS AND RELATED METHODS

(71) Applicant: Andrew Bilardello, Wildwood, FL (US)

(72) Inventor: Andrew Bilardello, Wildwood, FL (US)

( * ) Notice: Subject to any disclaimer, the term of this patent is extended or adjusted under 35 U.S.C. 154(b) by 165 days.

(21) Appl. No.: 16/916,568

(22) Filed: Jun. 30, 2020

(65) Prior Publication Data

US 2021/0079636 A1 Mar. 18, 2021

Related U.S. Application Data

(60) Provisional application No. 62/901,942, filed on Sep. 18, 2019.

(51) Int. Cl.
*E03C 1/308* (2006.01)

(52) U.S. Cl.
CPC ..... *E03C 1/308* (2013.01)

(58) Field of Classification Search
CPC . E03C 1/304; E03C 1/308; E03C 1/30; E03C 11/00
USPC ..... 4/255.05, 255.11
See application file for complete search history.

(56) References Cited

U.S. PATENT DOCUMENTS 930,236 A * 8/1909 Schacht ..... E03C 1/308 292/DIG. 28
987,217 A * 3/1911 Conner ..... E03C 1/308 4/255.02
1,684,880 A 9/1928 Norton
1,972,114 A * 9/1934 Stephenson ..... E03C 1/308 4/255.12
2,042,372 A * 5/1936 Watson ..... E03C 1/308 4/255.11
2,056,018 A 9/1936 Popp
4,186,451 A 2/1980 Ruo
4,622,702 A * 11/1986 Allen ..... E03C 1/308 4/255.12
4,745,641 A 5/1988 Tash
5,239,708 A 8/1993 Irwin
6,067,668 A 5/2000 Rudd
6,393,626 B1 * 5/2002 Dhillon ..... E03C 1/308 4/255.11
6,434,760 B1 * 8/2002 Montalvo ..... E03C 1/308 4/255.05
6,550,074 B1 4/2003 Allenbaugh et al.
6,684,417 B1 * 2/2004 Schneider ..... E03C 1/308 4/255.05

(Continued)

*Primary Examiner* — Benjamin R Shaw
(74) *Attorney, Agent, or Firm* — Allen, Dyer, Doppelt + Gilchrist, PA

(57) ABSTRACT

A plunger device may include a bellows having a proximal end and a distal end, and a handle coupled to the proximal end of the bellows and configured to switch between a first state comprising fluidly coupling an interior of the bellows to an ambient environment to permit inflation of the bellows, and a second state including sealing the interior of the bellows. The plunger device may include a tubular shaft coupled to the distal end of the bellows, and a flexible flange member coupled to the tubular shaft opposite the bellows and to be positioned within a drain so that positive pressure air flow is applied to the drain when the bellows is compressed while in the second state.

20 Claims, 14 Drawing Sheets

(56) References Cited

U.S. PATENT DOCUMENTS

| | | | | |
|---|---|---|---|---|
| 7,340,783 | B2 | 3/2008 | Leaphart, Jr. et al. | |
| 10,221,551 | B2 | 3/2019 | Gray | |
| 2001/0037522 | A1* | 11/2001 | Pool | E03C 1/308 4/255.11 |
| 2003/0079278 | A1* | 5/2003 | Tash | E03C 1/30 4/255.11 |
| 2008/0193308 | A1 | 8/2008 | Korcoban | |
| 2010/0058519 | A1 | 3/2010 | Davenport | |
| 2011/0219526 | A1* | 9/2011 | Keegan | E03C 1/308 4/255.12 |
| 2012/0011643 | A1* | 1/2012 | Schultz | A47K 11/10 4/255.05 |
| 2012/0233757 | A1* | 9/2012 | Slot | E03D 9/00 4/255.05 |
| 2012/0247519 | A1 | 10/2012 | Dondurur et al. | |
| 2015/0273541 | A1* | 10/2015 | Kim | B08B 9/0557 15/3.5 |
| 2017/0022694 | A1* | 1/2017 | Broten | E03D 9/00 |
| 2019/0329302 | A1* | 10/2019 | Wu | F04B 43/0072 |
| 2020/0024839 | A1* | 1/2020 | Tapper | E03D 9/00 |
| 2020/0240127 | A1* | 7/2020 | Tash | E03C 1/308 |

* cited by examiner

PRESSURE ASSISTED PLUNGER DEVICE WITH SWITCHING BELLOWS AND RELATED METHODS

RELATED APPLICATION

This application is based upon prior filed Application No. 62/901,942 filed Sep. 18, 2019, the entire subject matter of which is incorporated herein by reference in its entirety.

TECHNICAL FIELD

The present disclosure relates to the field of plumbing tools, and, more particularly, to toilet plunger devices and related methods.

BACKGROUND

Toilet plunger devices (drain opening devices) are ubiquitous in the typical home and commercial environment. This is due to the propensity of toilet drains to become obstructed. When the toilet drain is obstructed, a plunger device may be used to urge the obstruction down the toilet drain. The typical plunger device includes a shaft, and a flexible flange member or cup coupled to a distal end of the shaft. The user applies the flexible flange member to the toilet drain and compresses the flexible flange member to create positive pressure.

SUMMARY

Generally, a plunger device may include a bellows having a proximal end and a distal end, and a handle coupled to the proximal end of the bellows and configured to switch between a first state comprising fluidly coupling an interior of the bellows to an ambient environment to permit inflation of the bellows, and a second state comprising sealing the interior of the bellows. The plunger device may include a tubular shaft coupled to the distal end of the bellows, and a flexible flange member coupled to the tubular shaft opposite the bellows and to be positioned within a drain so that positive pressure air flow is applied to the drain when the bellows is compressed while in the second state.

In particular, the proximal end of the bellows may define a first plurality of ports fluidly coupled with the interior of the bellows. The handle may comprise a grip portion to be actuated by a user, and a tube section extending from the grip portion for coupling to the proximal end of the bellows. The tube section may define a second plurality of ports.

Additionally, the first plurality of ports may overlap the second plurality of ports in the first state, and the first plurality of ports may be radially offset from the second plurality of ports in the second state. The handle may rotate to switch between the first state and the second state.

Also, the flexible flange member may comprise a tube section, and a flange extending radially outward from the tube section and comprising an annular ring, and first and second arms extending between the tube section and the annular ring. The tube section may comprise a proximal end coupled to the tubular shaft, and a distal end to be positioned within the drain. In some embodiments, the proximal end of the tube section may define a third plurality of ports. In other embodiments, the distal end of the tube section is open and fluidly coupled to the interior of the bellows. The proximal end and the distal end of the tube section may each extend outward and away from the flange.

Another aspect is directed to a method of making a plunger device. The method may include coupling a handle coupled to a proximal end of a bellows, the handle configured to switch between a first state comprising fluidly coupling an interior of the bellows to an ambient environment to permit inflation of the bellows, and a second state comprising sealing the interior of the bellows. The method may include coupling a tubular shaft to a distal end of the bellows, and coupling a flexible flange member to the tubular shaft opposite the bellows and to be positioned within a drain so that positive pressure air flow is applied to the drain when the bellows is compressed while in the second state.

DETAILED DESCRIPTION

Figure 1:
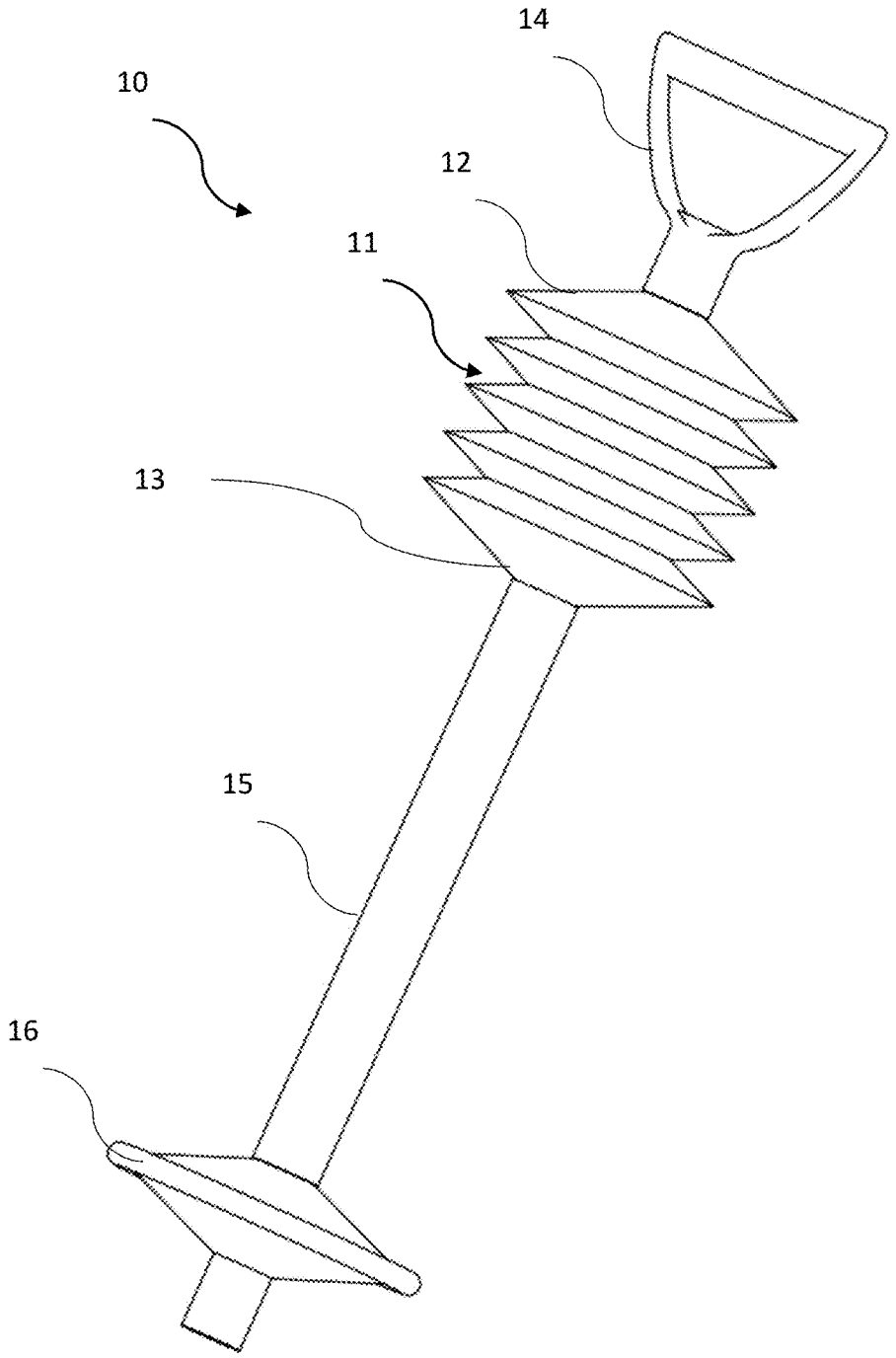
FIG. 1 is a schematic diagram of a plunger device, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

For stubborn obstructed drains, the user may struggle with typical plunger devices. For the classic plunger type, these struggles may include repeated compressions of the plunger device to urge the obstruction out of the drain.

One approach to these issues has been pressure assisted plunger devices. Nonetheless, typical pressure assisted plunger devices may have drawbacks. For example, some approaches are complicated and have many parts, which drives up costs and makes the plunger device difficult to maintain and clean. Some pressure assisted approaches omit intake valves. Without the intake valve, for repeated applications of the device, the user needs to remove and reposition the plunger device in the drain, which can be cumbersome.

Referring initially to FIGS. 1-4B, a plunger device 10 according to the present disclosure is now described. The plunger device 10 may provide an approach to the above noted issues with existing approaches to remove obstructions in drains (e.g. toilet drain, sink drain).

The plunger device 10 illustratively includes a bellows 11 having a proximal end 12 and a distal end 13. The bellows 11 may comprise a flexible material, such as a rubber material, a polymer plastic material, or a fabric material. In particular, the bellows 11 illustratively comprises concertinaed sides for permitting the compression and expansion of the bellows body.

Figure 2A:
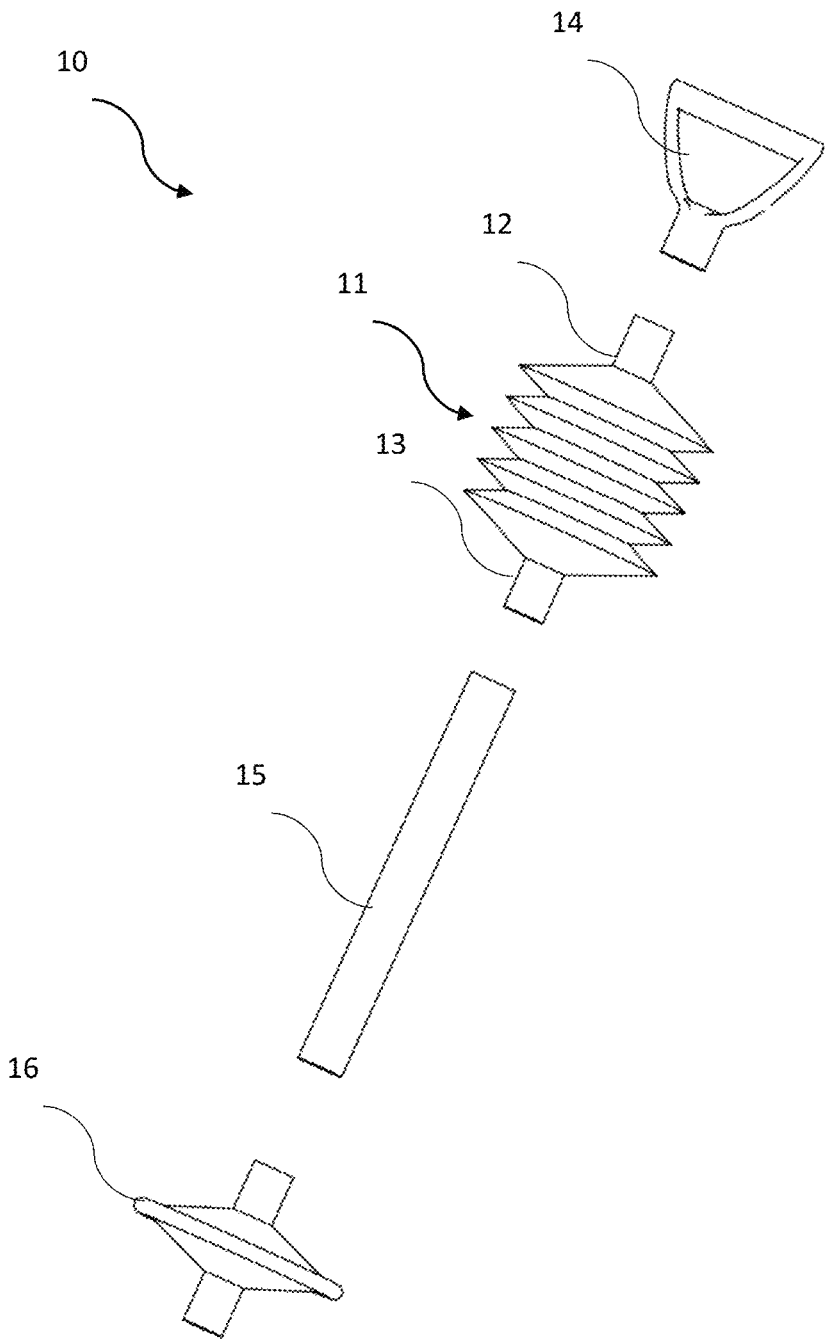
FIG. 2A is a schematic exploded view of the plunger device of FIG. 1.
Figure 2B:
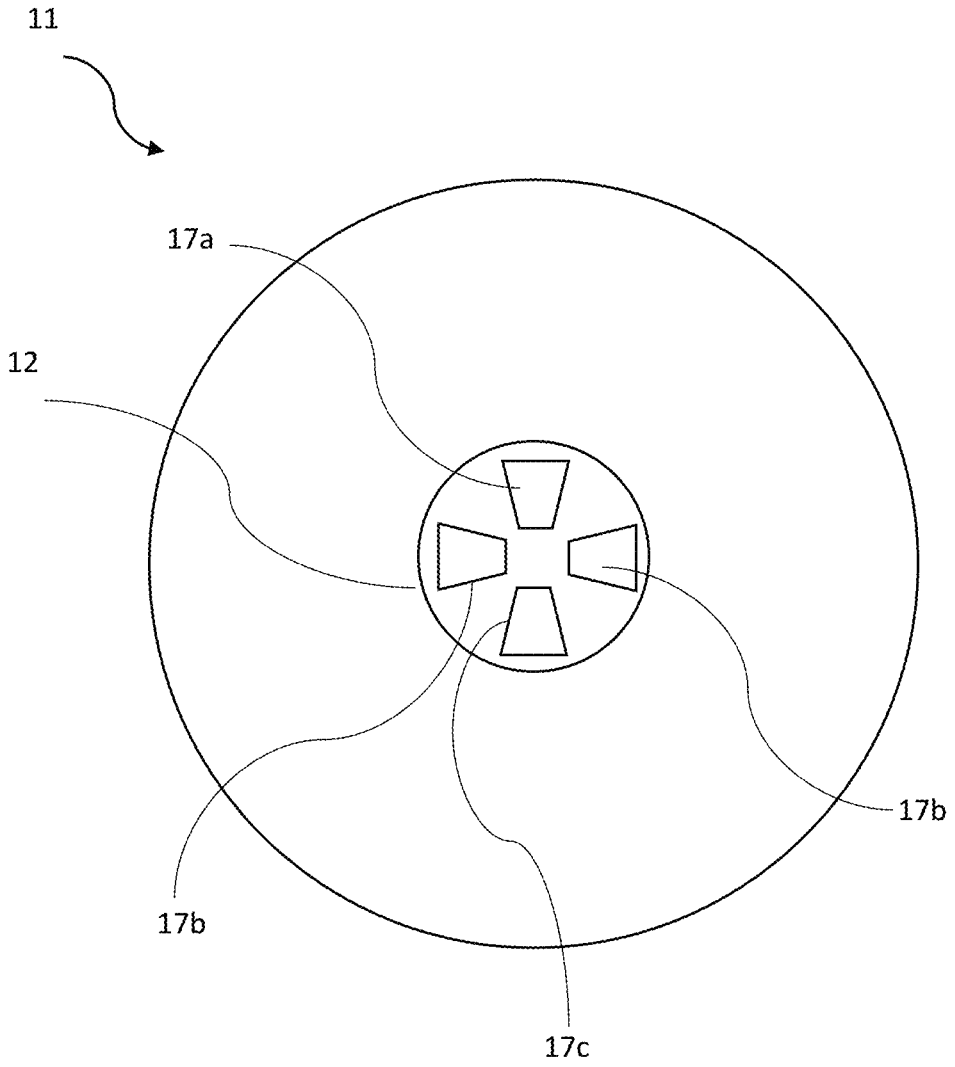
FIG. 2B is a schematic top plan view of the bellows from the plunger device of FIG. 1.
Figure 3:
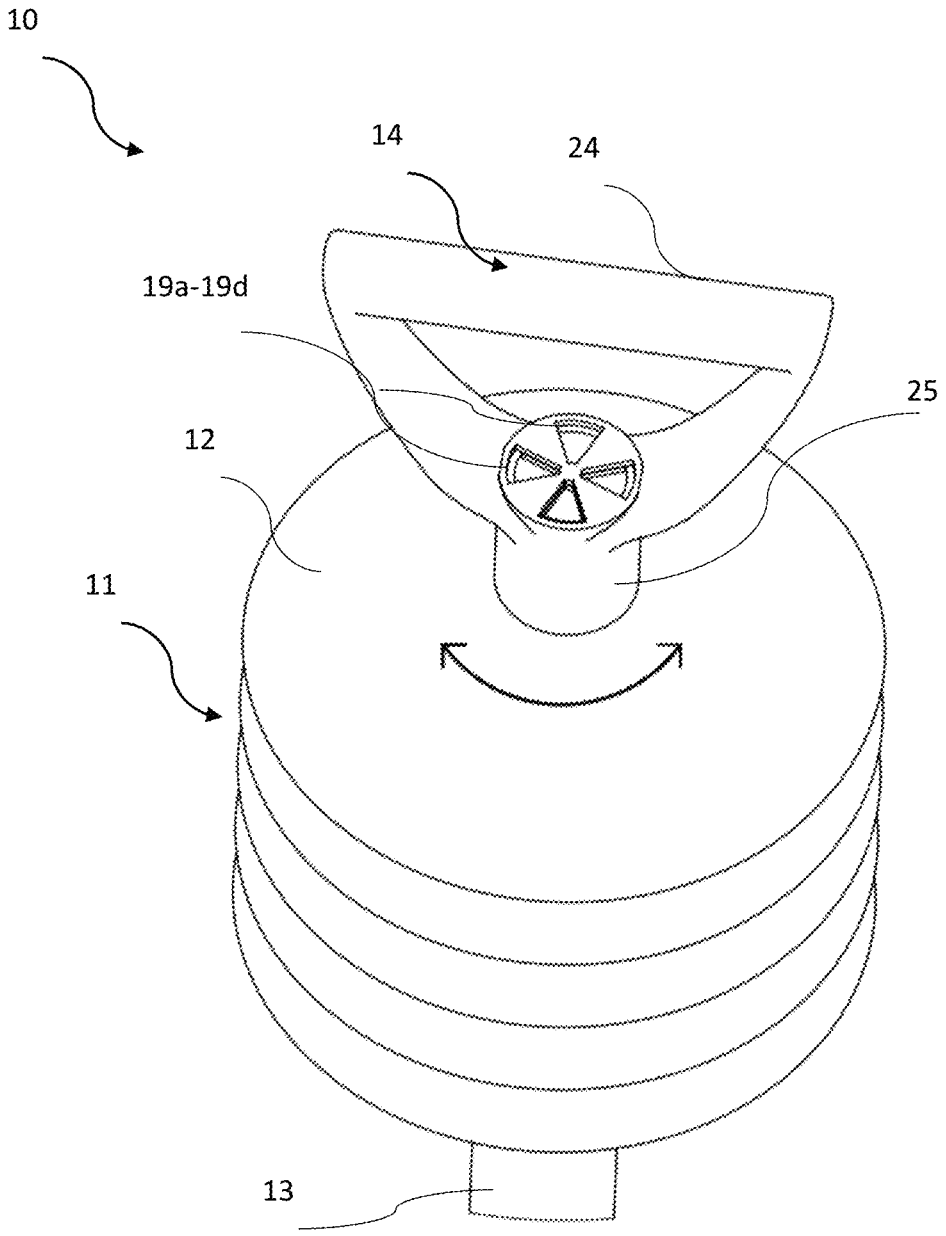
FIG. 3 is a schematic top plan view of the plunger device of FIG. 1 without the shaft and flexible flange member.

As perhaps best seen in FIGS. 2A & 3, the bellows 11 comprises tube sections on opposing ends. The tube section on the proximal end 12 of the bellows 11 defines a partially closed end. As perhaps best seen in FIG. 2B, the tube section on the proximal end 12 of the bellows 11 defines a first plurality of ports 17*a*-17*d*. Each of the first plurality of ports 17*a*-17*d* is illustratively truncated pie section-shaped (i.e. a circle segment), but in other embodiments, the first plurality of ports may have other shapes (e.g. circle-shaped, rectangle-shaped, triangle-shaped, or trapezoid-shaped).

The plunger device 10 illustratively includes a handle 14 coupled to the proximal end 12 of the bellows 11. The handle 14 illustratively includes a grip portion 24 for actuation by a user, and a handle tube section 25 for coupling to the tube section on the proximal end 12 of the bellows 11. As perhaps best seen in FIG. 3, the handle tube section 25 illustratively defines a second plurality of ports 19*a*-19*d* for aligning with the first plurality of ports 17*a*-17*d*. In other words, the first plurality of ports 17*a*-17*d* is substantially (i.e. ±10% in total area difference) identical to the second plurality of ports 19*a*-19*d* in shape and size.

Figure 4A:
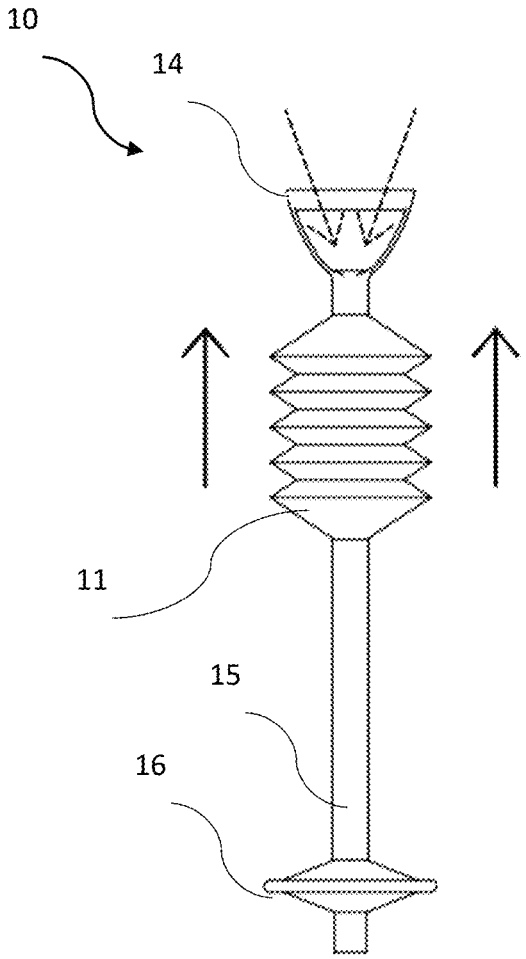
FIGS. 4A and 4B are schematic diagrams of the plunger device of FIG. 1 in the first state and the second state, respectively.
Figure 4B:
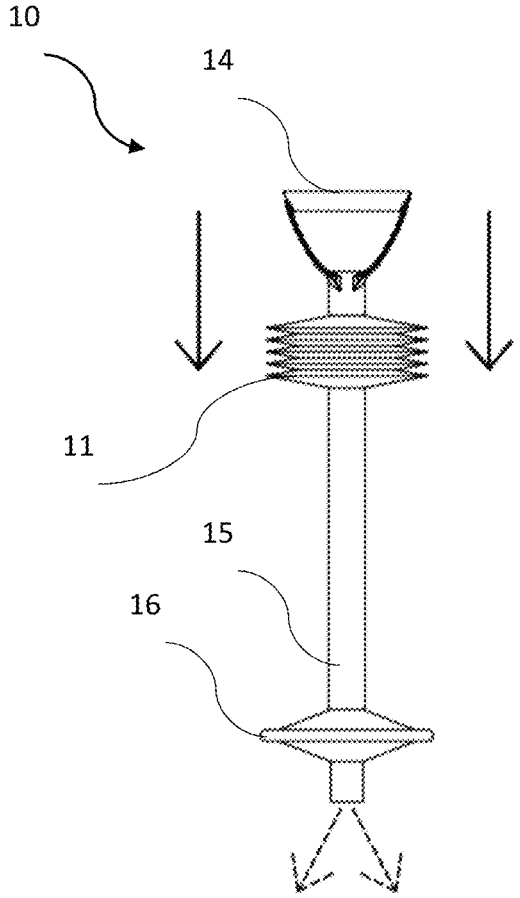

As shown in FIG. 3, the handle 14 is configured to switch between a first state (FIG. 4A) and a second state (FIG. 4B). The user may twist the grip portion 24 to align the first and second pluralities of ports 17*a*-17*d*, 19*a*-19*d* to open the interior of the bellows 11 to ambient environment in the first state. In other words, the first state (FIG. 4A) includes fluidly coupling the interior of the bellows 11 to ambient environment to permit inflation of the bellows body.

The user may twist the grip portion 24 to radially offset the first and second pluralities of ports 17*a*-17*d*, 19*a*-19*d* to close the interior of the bellows 11 to the ambient atmosphere in the second state. Here, the second state (FIG. 4B) comprises sealing the interior of the bellows 11 to the ambient environment.

The plunger device 10 illustratively includes a tubular shaft 15 coupled to the distal end 13 of the bellows 11, and a flexible flange member 16 coupled to the tubular shaft opposite the bellows. The tubular shaft 15 comprises a hollow tube, and may comprise one or more of a metallic material, and a plastic polymer material.

Figure 5A:
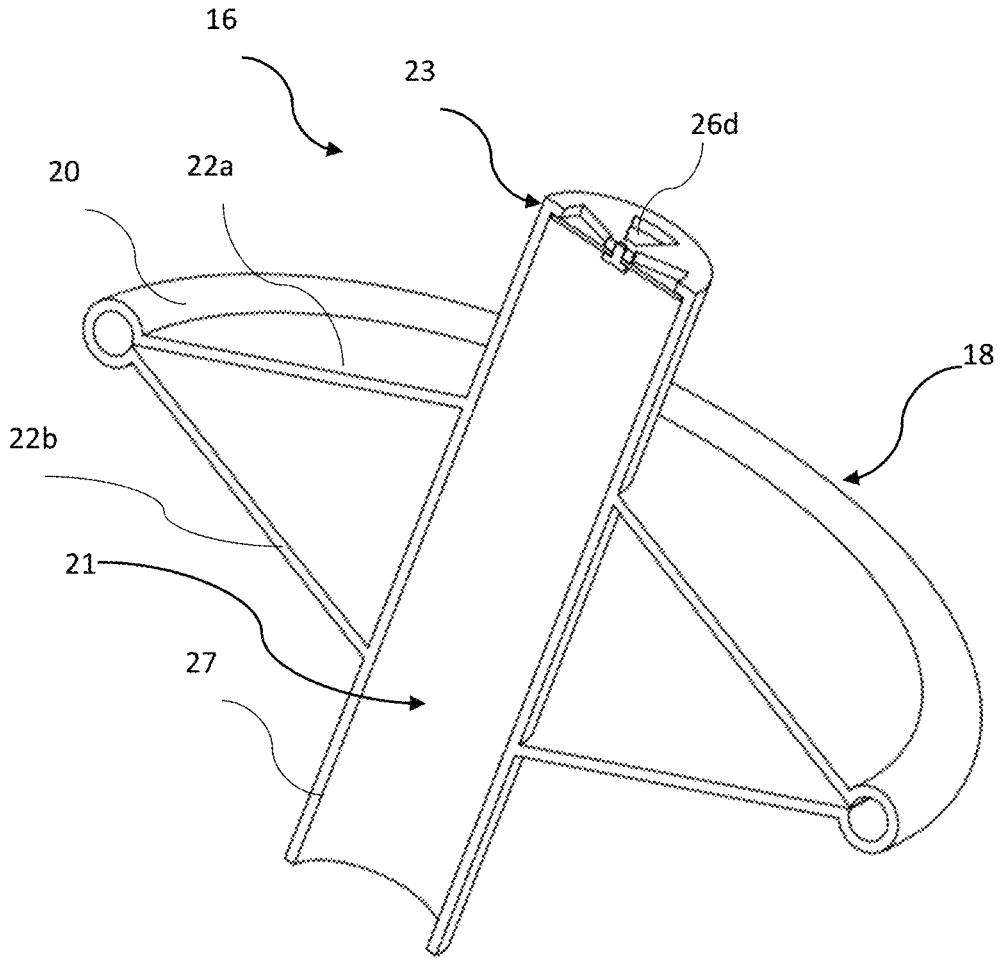
FIG. 5A is a cross-sectional schematic view of the flexible flange member from the plunger device of FIG. 1.
Figure 5B:
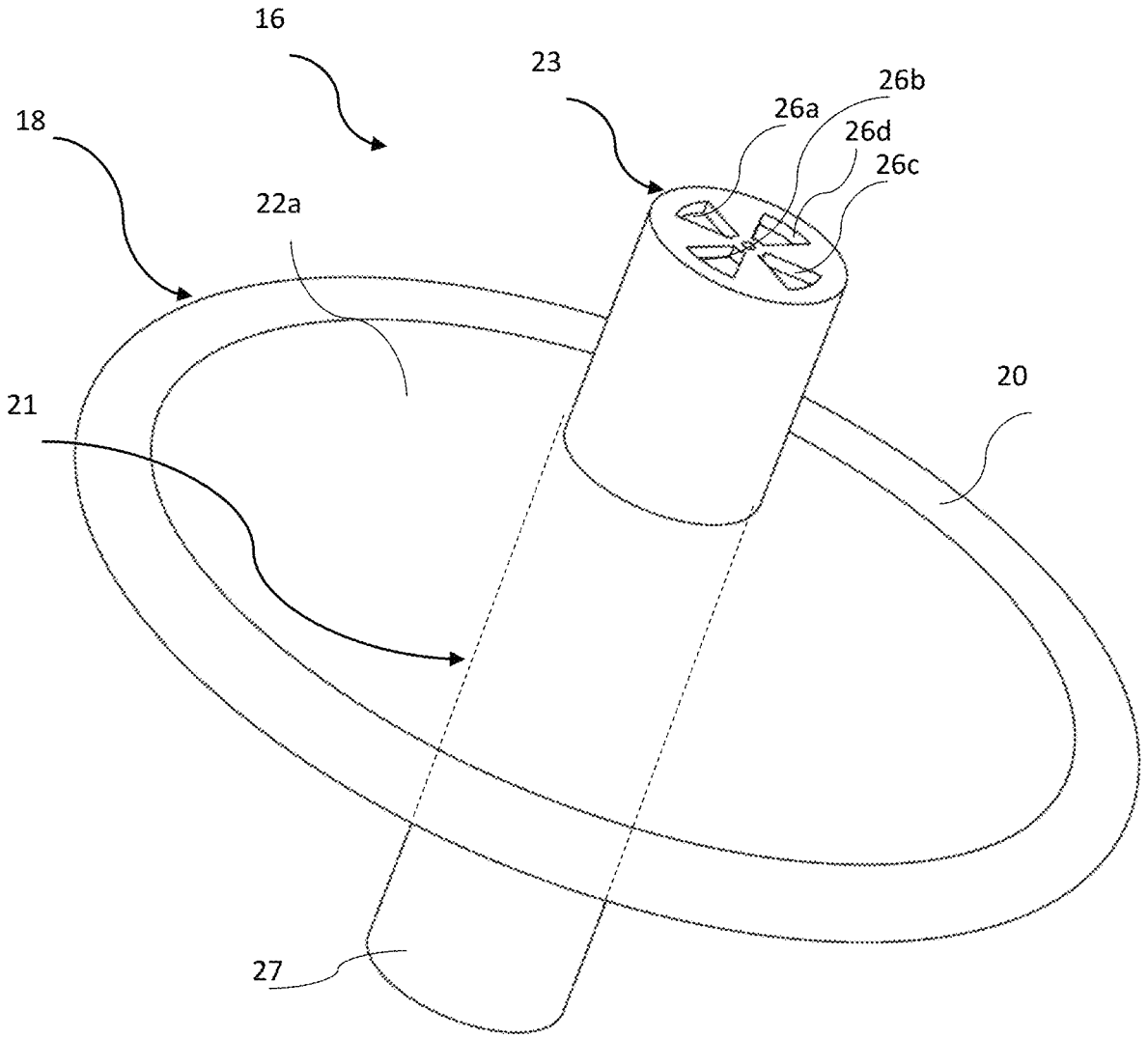
FIG. 5B is a perspective schematic view of the flexible flange member from the plunger device of FIG. 1.

As perhaps best seen in FIGS. 5A-5B, the flexible flange member 16 illustratively includes a central tube section 21 having a proximal end 23 with a third plurality of ports 26*a*-26*d* for coupled to a distal end of the tubular shaft 15. The central tube section 21 illustratively comprises a distal end 27 opposite the proximal end 23.

In some embodiments, the third plurality of ports 26*a*-26*d* may be part of an air valve. In some embodiments, the air valve may comprise a 1-way air valve, permitting flow only downward through the flexible flange member 16 (i.e. preventing application of suction force to the drain). The flexible flange member 16 illustratively comprises a flange 18 extending radially outward from the central tube section 21. The flange 18 comprises an outer ring 20, and first and second arms 22*a*-22*b* extending between the central tube section 21 and the outer ring.

In some embodiments, the flexible flange member 16 comprises one or more materials, such as a rubber material, and a plastic polymer material. In particular, for example, the outer ring 20 and first and second arms 22*a*-22*b* may comprise a rubber material, and the central tube section 21 may comprise a more rigid material, such as a plastic material or a metallic material.

In the illustrated embodiment, the distal end 27 of the central tube section 21 comprises a straight open tube end. In other embodiments, the distal end 27 of the central tube section 21 may comprise a tapered end to increase fluid output force. In yet other embodiments, the distal end 27 of the central tube section 21 comprises a curved end to be angled within the drain.

Another aspect is directed to a method for making a plunger device 10. The method includes forming a bellows 11 having a proximal end 12 and a distal end 13, and coupling a handle 14 to the proximal end of the bellows and configured to switch between first and second states. The first state includes fluidly coupling an interior of the bellows 11 to ambient environment to permit inflation of the bellows, and the second state comprises sealing the interior of the bellows. The method includes coupling a tubular shaft 15 to the distal end 13 of the bellows 11, and coupling a flexible flange member 16 to the tubular shaft 15 opposite the bellows and to be positioned within a toilet drain so that positive pressure air flow is applied to the toilet drain when the bellows is compressed while in the second state.

As will be appreciated, the plunger device 10 may be used to clear an obstructed drain, for example, a toilet drain. Of course, the plunger device 10 may be used to clear any obstructed drain, regardless of type or application. To clear the obstructed drain, the flexible flange member 16 is positioned within an opening of the obstructed drain. In particular, the distal end 27 of the central tube section 21 is inserted in the drain. Here, the outer ring 20 cooperates with adjacent portions of the surrounding housing of the obstructed drain to form a seal (i.e. an air tight/hermetic seal or a substantially air tight/hermetic seal).

Once in place, the user places the plunger device 10 into the first state and inflates the bellows 11. The user then places the plunger device 10 into the second state, and compresses the bellows 11 via the grip portion 24. The air within the bellows 11 is forced through the tubular shaft 15 and the central tube section 21 of the flexible flange member 16, and lastly into the obstructed drain. The positive pressure should dislodge the obstruction and clear the drain. If after the first application, the drain remains obstructed, the user can place the plunger device 10 back into the first state for re-inflation of the bellows 11 and repeat the process until the drain is cleared.

Figure 5C:
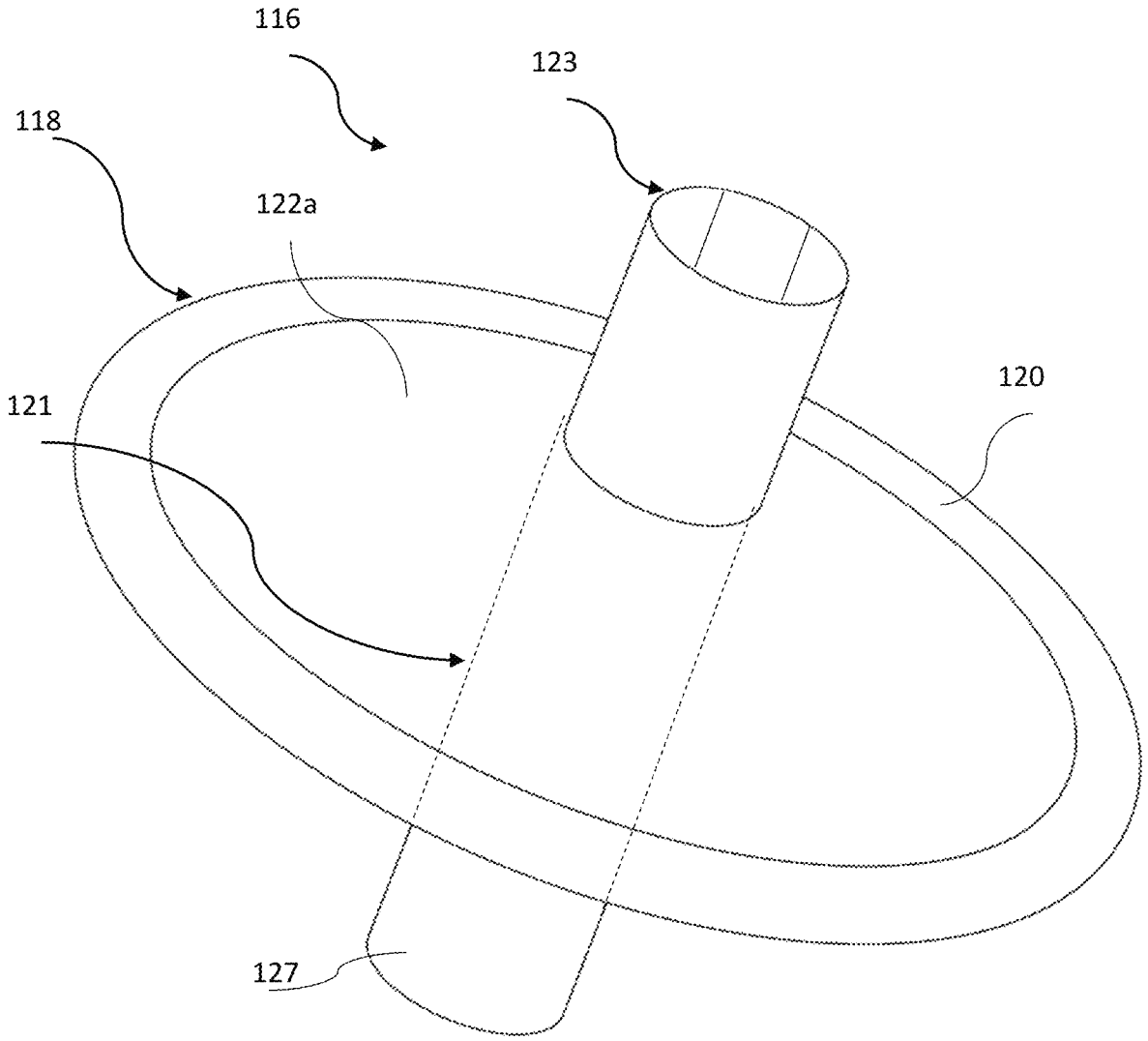
FIG. 5C is a perspective schematic view of another embodiment of the flexible flange member.
Figure 6:
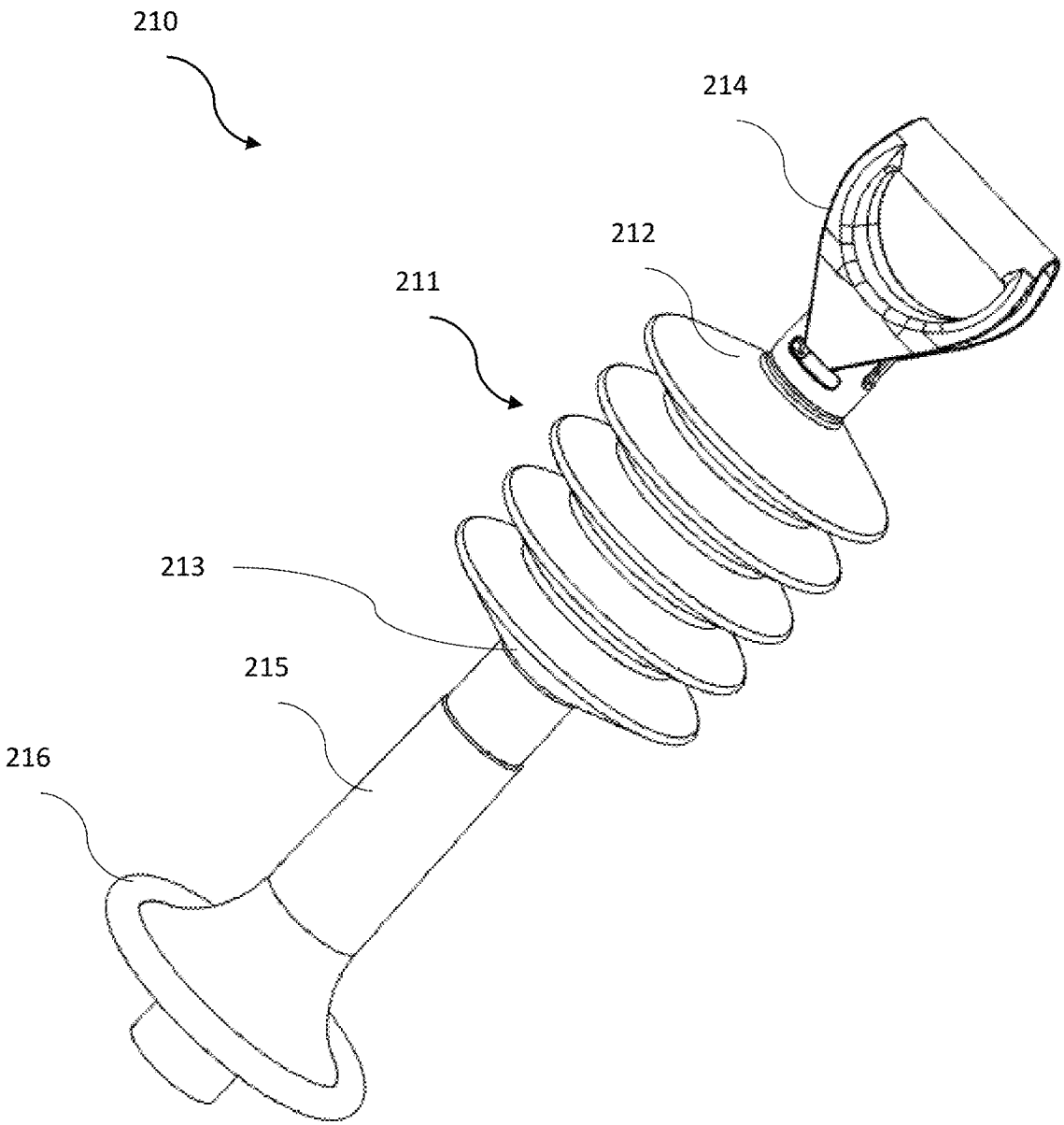
FIG. 6 is a perspective schematic view of another embodiment of the plunger device.

Referring now additionally to FIG. 5C, another embodiment of the flexible flange member 116 is now described. In this embodiment of the flexible flange member 116, those elements already discussed above with respect to FIGS. 1-5B are incremented by 100 and most require no further discussion herein. This embodiment differs from the previous embodiment in that this flexible flange member 116 illustratively omits the third plurality of ports from the embodiment of FIGS. 5A-5B, which are replaced with an open proximal end of the central tube section 121. In other words, in this embodiment, the central tube section 121 comprises a straight tube with no obstructions.

Referring now additionally to FIGS. 6 & 7A-7E, another embodiment of the plunger device 210 is now described. In this embodiment of the plunger device 210, those elements already discussed above with respect to FIGS. 1-5B are incremented by 200 and most require no further discussion herein. As perhaps best seen in FIGS. 7A-7B, this embodiment differs from the previous embodiment in that this plunger device 210 illustratively includes a flexible flange member 216 having a single arm 222 defining an annular recess 230 surrounding the distal end 227 of the central tube section 221. Also, the central tube section 221 illustratively includes a radial extension 231 adjacent the single arm 222 and cooperates therewith to define the annular recess 230.

Figure 7A:
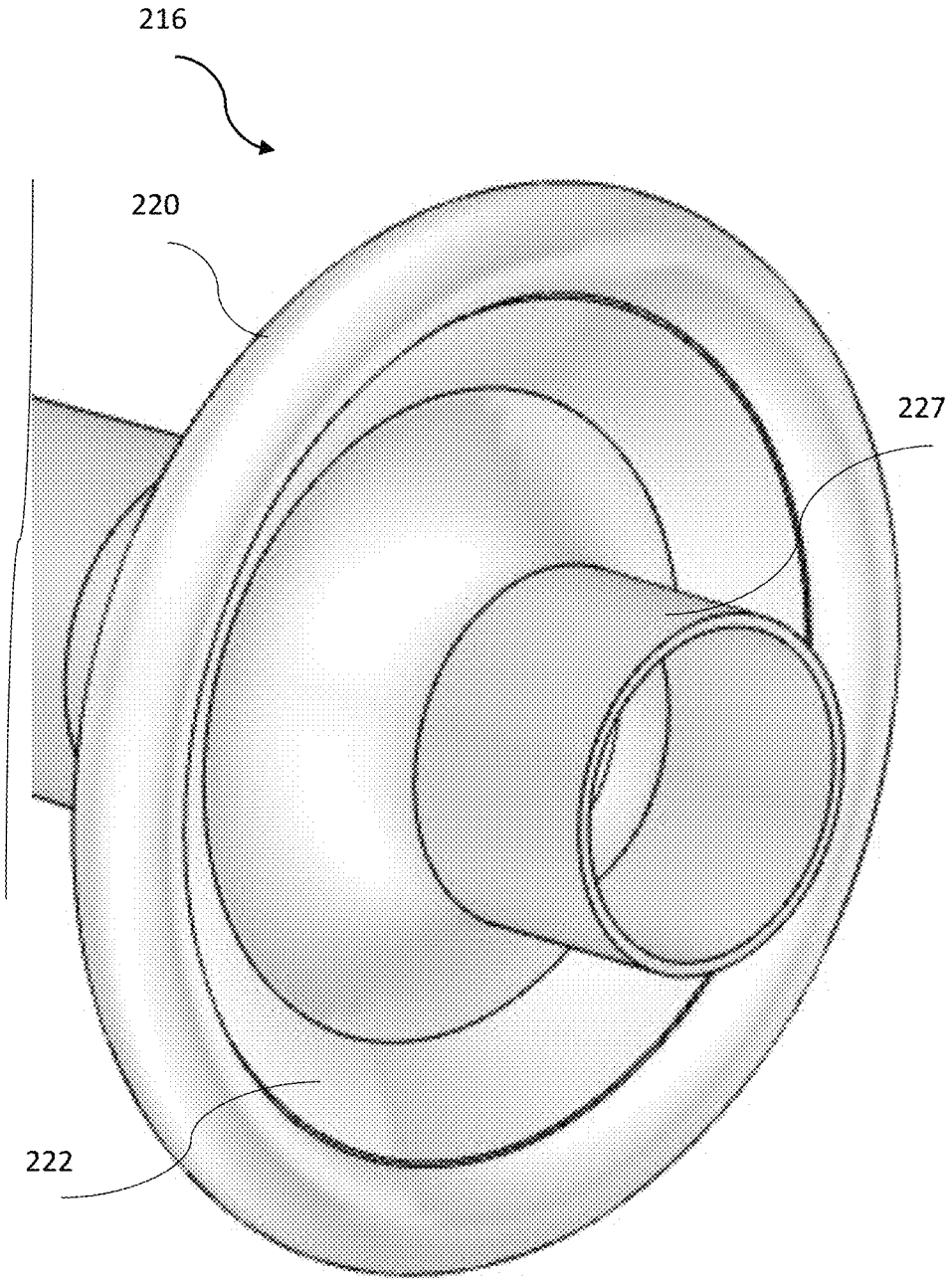
FIG. 7A is a perspective schematic view of the flexible flange member from the plunger device of FIG. 6.
Figure 7B:
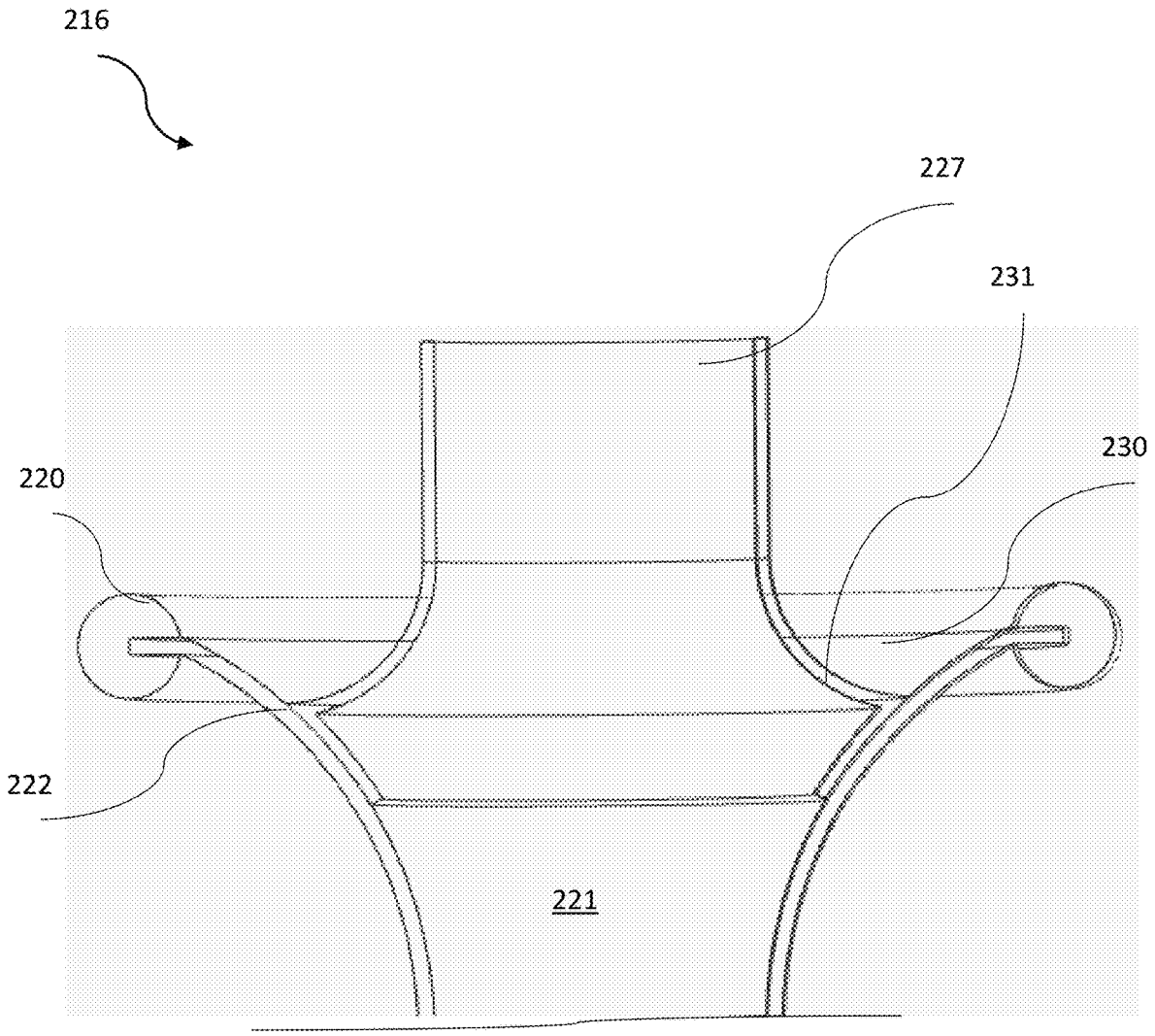
FIG. 7B is a cross-sectional schematic view of the flexible flange member from the plunger device of FIG. 6.
Figure 7C:
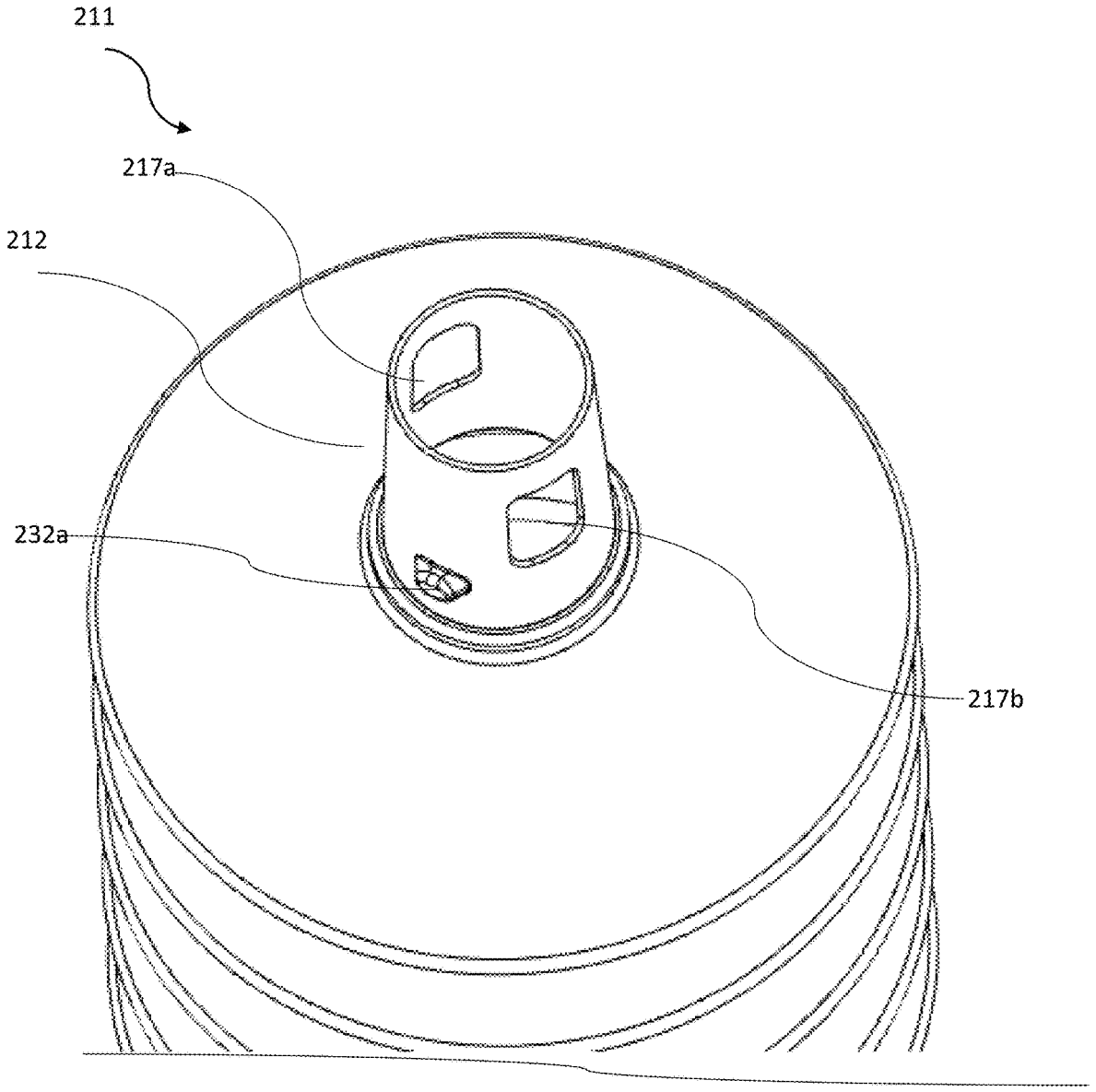
FIG. 7C is a perspective schematic view of the bellows from the plunger device of FIG. 6.
Figure 7D:
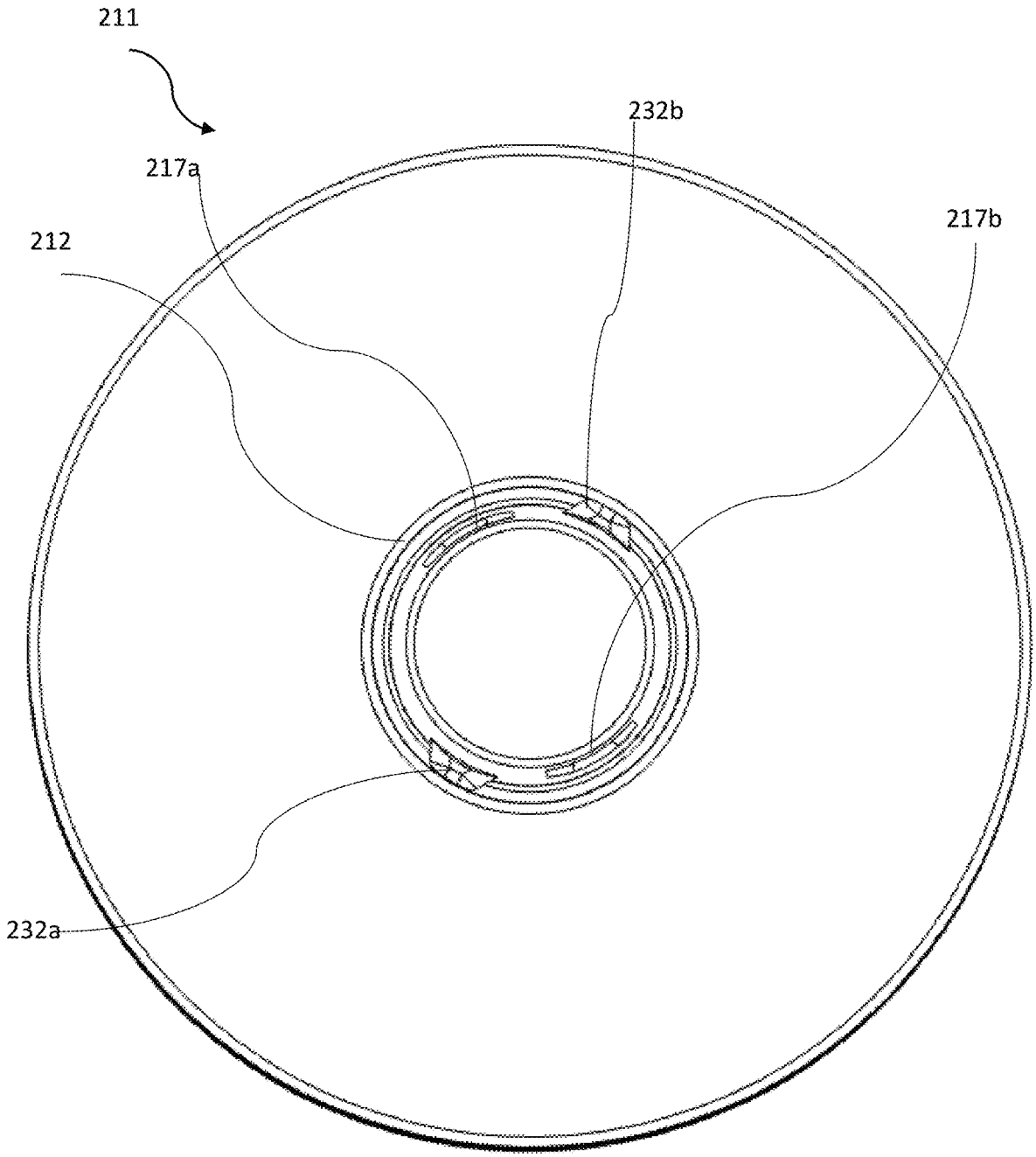
FIG. 7D is a perspective top plan view of the bellows from the plunger device of FIG. 6.
Figure 7E:
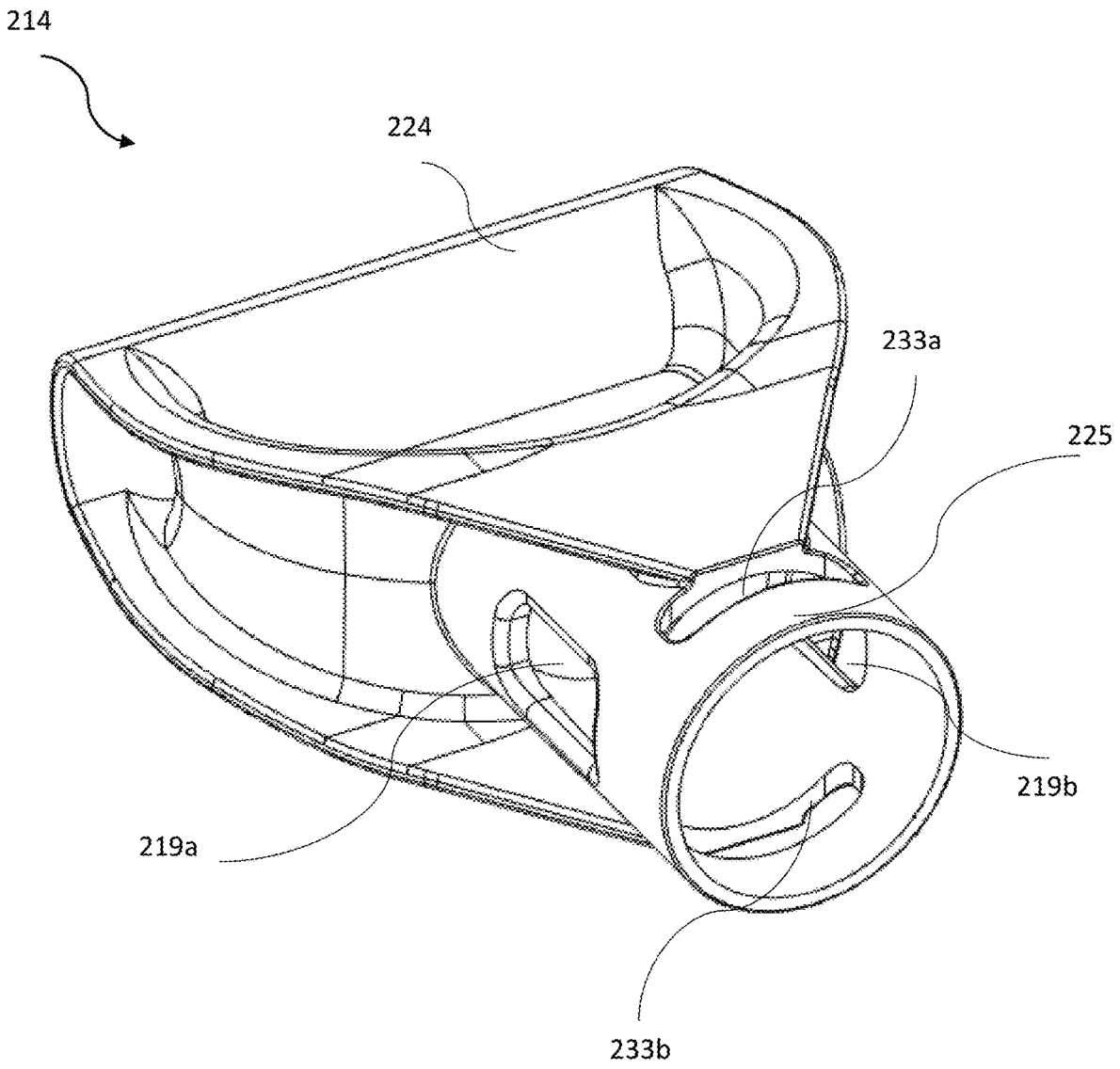
FIG. 7E is a perspective schematic view of the handle from the plunger device of FIG. 6.

As perhaps best seen in FIGS. 7C-7E, the first and second pluralities of ports 217*a*-217*b*, 219*a*-219*b* are located on sidewalls of the tube section on the proximal end 212 of the bellows 211 and the handle tube section 225 of the handle 214, respectively. Also, the first and second pluralities of ports 217*a*-217*b*, 219*a*-219*b* are rectangle-shaped with rounded corners.

Moreover, this embodiment includes a guide feature for switching the plunger device 210 between the first and second states. In particular, the tube section on the proximal end 212 of the bellows 211 illustratively comprises a plurality of guide protrusions 232*a*-232*b*, and the handle tube section 225 of the handle 214 defines a plurality of slots 233*a*-233*b* for respectively receiving the plurality of guide protrusions. As will be appreciated, the guide feature is configured so that the opposing ends of travel relate to the first and second states, respectively.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A plunger device comprising:
- a bellows having a proximal end and a distal end;
- a handle coupled to said proximal end of said bellows and configured to switch between
  - a first state comprising fluidly coupling an interior of said bellows to an ambient environment to permit inflation of said bellows, and
  - a second state comprising sealing the interior of said bellows;
- a tubular shaft coupled to said distal end of said bellows; and
- a flexible flange member coupled to said tubular shaft opposite said bellows and to be positioned within a drain so that positive pressure air flow is applied to the drain when said bellows is compressed while in the second state.

2. The plunger device of claim 1 wherein said proximal end of said bellows defines a first plurality of ports fluidly coupled with the interior of said bellows.

3. The plunger device of claim 2 wherein said handle comprises a grip portion to be actuated by a user, and a tube section extending from said grip portion for coupling to said proximal end of said bellows; and wherein said tube section defines a second plurality of ports.

4. The plunger device of claim 3 wherein the first plurality of ports overlaps the second plurality of ports in the first state; and wherein the first plurality of ports is radially offset from the second plurality of ports in the second state.

5. The plunger device of claim 4 wherein said handle rotates to switch between the first state and the second state.

6. The plunger device of claim 1 wherein said flexible flange member comprises:
- a tube section; and
- a flange extending radially outward from said tube section and comprising an annular ring, and first and second arms extending between said tube section and said annular ring.

7. The plunger device of claim 6 wherein said tube section comprises a proximal end coupled to said tubular shaft, and a distal end to be positioned within the drain.

8. The plunger device of claim 7 wherein said proximal end of said tube section defines a third plurality of ports.

9. The plunger device of claim 7 wherein said distal end of said tube section is open and fluidly coupled to the interior of said bellows.

10. The plunger device of claim 7 wherein said proximal end and said distal end of said tube section each extends outward and away from said flange.

11. A plunger device comprising:
- a bellows having a proximal end and a distal end, said proximal end of said bellows defining a first plurality of ports fluidly coupled with an interior of said bellows;
- a handle coupled to said proximal end of said bellows and comprising a grip portion to be actuated by a user, and a tube section extending from said grip portion for coupling to said proximal end of said bellows, said tube section defining a second plurality of ports;
- said handle configured to switch between
  - a first state comprising fluidly coupling the interior of said bellows to an ambient environment to permit inflation of said bellows, and
  - a second state comprising sealing the interior of said bellows;
- a tubular shaft coupled to said distal end of said bellows; and
- a flexible flange member coupled to said tubular shaft opposite said bellows and comprising
  - a tube section, and
  - a flange extending radially outward from said tube section and comprising an annular ring, and first and second arms extending between said tube section and said annular ring.

12. The plunger device of claim 11 wherein the first plurality of ports overlaps the second plurality of ports in the first state; and wherein the first plurality of ports is radially offset from the second plurality of ports in the second state.

13. The plunger device of claim 12 wherein said handle rotates to switch between the first state and the second state.

14. The plunger device of claim 11 wherein said tube section comprises a proximal end coupled to said tubular shaft, and a distal end to be positioned within a drain.

15. The plunger device of claim 14 wherein said proximal end of said tube section defines a third plurality of ports.

16. The plunger device of claim 14 wherein said distal end of said tube section is open and fluidly coupled to the interior of said bellows.

17. The plunger device of claim 14 wherein said proximal end and said distal end of said tube section each extends outward and away from said flange.

18. A method of making a plunger device, the method comprising:

coupling a handle coupled to a proximal end of a bellows, the handle configured to switch between a first state comprising fluidly coupling an interior of the bellows to an ambient environment to permit inflation of the bellows, and a second state comprising sealing the interior of the bellows;

coupling a tubular shaft to a distal end of the bellows; and coupling a flexible flange member to the tubular shaft opposite the bellows and to be positioned within a drain so that positive pressure air flow is applied to the drain when the bellows is compressed while in the second state.

19. The method of claim 18 wherein the proximal end of the bellows defines a first plurality of ports fluidly coupled with the interior of the bellows.

20. The method of claim 19 wherein the handle comprises a grip portion to be actuated by a user, and a tube section extending from the grip portion for coupling to the proximal end of the bellows; wherein the tube section defines a second plurality of ports; wherein the first plurality of ports overlaps the second plurality of ports in the first state; wherein the first plurality of ports is radially offset from the second plurality of ports in the second state; and wherein the handle rotates to switch between the first state and the second state.

* * * * *